US010930224B2

(12) United States Patent
Wang et al.

(10) Patent No.: US 10,930,224 B2
(45) Date of Patent: Feb. 23, 2021

(54) METHOD OF ELIMINATING BLACK BORDER OF DISPLAY DEVICE, DISPLAY DEVICE AND DETECTING DEVICE

(71) Applicants: Beijing BOE Optoelectronics Technology Co., Ltd., Beijing (CN); BOE Technology Group Co., Ltd., Beijing (CN)

(72) Inventors: Boning Wang, Beijing (CN); Hongliang Lv, Beijing (CN); Ruifeng Yang, Beijing (CN); Litao Fan, Beijing (CN); Yufei Liu, Beijing (CN); Libao Cui, Beijing (CN); Huaxu Yang, Beijing (CN); Qingnan Ai, Beijing (CN); Fang Zhang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 8 days.

(21) Appl. No.: 16/468,509

(22) PCT Filed: Nov. 28, 2018

(86) PCT No.: PCT/CN2018/117879
§ 371 (c)(1),
(2) Date: Jun. 11, 2019

(87) PCT Pub. No.: WO2019/205620
PCT Pub. Date: Oct. 31, 2019

(65) Prior Publication Data

US 2020/0294456 A1 Sep. 17, 2020

(30) Foreign Application Priority Data

Apr. 28, 2018 (CN) ..... 201810403297.4

(51) Int. Cl.
*G09G 3/34* (2006.01)

(52) U.S. Cl.
CPC ..... *G09G 3/3413* (2013.01); *G09G 2320/02* (2013.01)

(58) Field of Classification Search
CPC ..... G09G 3/36; G09G 2320/02; G09G 3/006; G02F 1/1309; G02F 1/133308; H01L 27/3241; H01L 51/524
See application file for complete search history.

(56) References Cited

U.S. PATENT DOCUMENTS 8,362,993 B2 1/2013 Nakagawa
9,910,631 B2 3/2018 Wu
(Continued)

FOREIGN PATENT DOCUMENTS

CN 101562712 A 10/2009
CN 101931736 A 12/2010
(Continued)

OTHER PUBLICATIONS

English translation of International Search Report and Box V of the Written Opinion for International Application No. PCT/CN2018/117879, dated Mar. 1, 2019, 7 pages.
(Continued)

*Primary Examiner* — Nelson M Rosario
(74) *Attorney, Agent, or Firm* — Westman, Champlin & Koehler, P.A.

(57) ABSTRACT

The present disclosure provides a method of eliminating a black border of a display device, a display device and a detecting device. The display device includes a cover plate and a display panel, which are configured in a stack; the cover plate includes a light transmissive region and a non-light transmissive region located around the light transmissive region. The display panel includes a display area
(Continued)

corresponding to the light transmissive region. The display area includes a first sub-display area and a second sub-display area around the first sub-display area. A size of the display area is greater than a size of the light transmissive region of the cover plate and pixels of the second sub-display area on at least one side are configured to display the same color as the color of the non-light transmissive area.

9 Claims, 4 Drawing Sheets

(56) References Cited

U.S. PATENT DOCUMENTS

| | | | | |
|---|---|---|---|---|
| 9,959,824 | B2 | 5/2018 | Lee et al. | |
| 10,490,779 | B2 | 11/2019 | Zhou et al. | |
| 2011/0134022 | A1 | 6/2011 | Nakagawa | |
| 2014/0184472 | A1* | 7/2014 | Xia | G06F 3/1446 345/1.3 |
| 2015/0378663 | A1 | 12/2015 | Wu | |
| 2016/0104441 | A1 | 4/2016 | Lee et al. | |
| 2016/0202523 | A1* | 7/2016 | Xia | G02F 1/13336 349/58 |
| 2016/0216582 | A1 | 7/2016 | Lee et al. | |
| 2019/0165324 | A1 | 5/2019 | Zhou et al. | |
| 2019/0212621 | A1 | 7/2019 | Lee et al. | |

FOREIGN PATENT DOCUMENTS

| | | | |
|---|---|---|---|
| CN | 202870769 | U | 4/2013 |
| CN | 104091522 | A | 10/2014 |
| CN | 104202646 | A | 12/2014 |
| CN | 105511181 | A | 4/2016 |
| CN | 105825827 | A | 8/2016 |
| CN | 107748461 | A | 3/2018 |
| CN | 107831612 | A | 3/2018 |
| CN | 108597469 | A | 9/2018 |
| TW | 201128511 | A1 | 8/2011 |
| WO | 2010/016197 | A1 | 2/2010 |

OTHER PUBLICATIONS

First Office Action, including Search Report, for Chinese Patent Application No. 201810403297.4, dated Jul. 24, 2019, 10 pages.

* cited by examiner

METHOD OF ELIMINATING BLACK BORDER OF DISPLAY DEVICE, DISPLAY DEVICE AND DETECTING DEVICE

CROSS-REFERENCE TO RELATED APPLICATION

This application is a Section 371 National Stage Application of International Application No. PCT/CN2018/117879, filed on Nov. 28, 2018, and claims priority to Chinese Patent Application No. 201810403297.4, filed with the State Intellectual Property Office of China on Apr. 28, 2018, the whole disclosures of which are incorporated herein by reference.

TECHNICAL FIELD

The present disclosure relates to the field of display technology, and particularly to a method of eliminating a black border of a display device, a display device and a detecting device.

DESCRIPTION OF RELATED ART

In the related art, a display device may include a cover plate and a display panel which are disposed in a stack. The display panel includes a display area and the cover plate may include a light transmissive region and a non-light transmissive region located around the light transmissive region. When the display device is normally displayed, a black border is often viewed at a border of the display area.

SUMMARY

Embodiments of the present disclosure provide a method of eliminating a black border of a display device, a display device and a detecting device, which may at least partially eliminate black border in a display device.

The present disclosure provide technical solutions that may solve technical problems.

The present disclosure provides a method of eliminating a black border of a display device, the display device comprising a cover plate and a display panel that are provided in a stack, the cover plate comprising a light transmissive region and a non-light transmissive region located around the light transmissive region and the display panel comprising a display area that is configured to correspond to the light transmissive region such that the display area is visible through the light transmissive region, wherein a size of the display area is greater than a size of the light transmissive region and the display area includes a first sub-display area and a second sub-display area located around the first sub-display area; the method comprising the steps of:

setting pixels of at least one side of the second sub-display area to display the same color as a color of the non-light transmissive area.

In an embodiment, before the pixels of at least one side of the second sub-display area are set to display the same color as a color of the non-light transmissive area, the method further comprises the following steps:

detecting a pixel location in the second sub-display area that corresponds to a boundary of the light transmissive region.

In an embodiment, the detecting a pixel location in the second sub-display area that corresponds to a boundary of the light transmissive region includes:

detecting a first pixel location in the second sub-display area that corresponds to a first boundary of the light transmissive region and a second pixel location in the second sub-display area that corresponds to a second boundary of the light transmissive region, the second boundary being opposite to the first boundary, a direction from the first boundary to the second boundary being a first direction.

In an embodiment, the detecting a first pixel location in the second sub-display area that corresponds to a first boundary of the light transmissive region and a second pixel location in the second sub-display area that corresponds to a second boundary of the light transmissive region includes:

displaying a scanning test line column by column from a side of the display area at the first boundary in the first direction; during the displaying the scanning test line, recording a position corresponding the time when the scanning test line starts to appear in the light transmission area as the first pixel location and recording a position corresponding to the time of disappearance of the scanning test line in the light transmission area as the second pixel location.

In an embodiment, the setting pixels of at least one side of the second sub-display area to display the same color as a color of the non-light transmissive area comprises:

determining, according to the first pixel location, the second pixel location, and the resolution of the first sub-display area in the first direction, the number of columns of pixels to be processed of the second sub-display area on the first pixel location side and/or the second pixel location side;

setting the pixels to be processed of the second sub-display area, in the light transmissive region, on the first pixel location side and/or on the second pixel location side to display the same color as the color of the non-light transmissive area.

In an embodiment, the light transmissive region is located at intermediate position of the display area;

the determining, according to the first pixel location, the second pixel location, and the resolution of the first sub-display area in the first direction, the number of columns of pixels to be processed of the second sub-display area on the first pixel location side and/or the second pixel location comprises:

calculating, according to the first pixel location and the second pixel location, a number of the columns of the first pixels to be processed of the second sub-display area, shielded by the non-light transmissive area, on the first pixel location side and/or the second pixel location side, and a number of columns of pixels of second sub-display area corresponding to the light transmissive region in the first direction;

calculating, according to the number of columns of pixels arranged in the first direction and corresponding to the light transmissive region and the resolution of the first sub-display area in the first direction, a number of the columns of the second pixels to be processed of the second sub-display area corresponding to the light transmissive region;

calculating, according to the number of columns of the first pixels to be processed of the second sub-display area on the first pixel location side and the number of columns of the second pixels to be processed, the number of the columns of the pixels to be processed of the second sub-display area on the first pixel location side and/or, according to the number of the columns of the first pixels to be processed of the second sub-display area on the side of the second pixel and the number of the columns of the second pixels to be processed, a number of the columns of the pixels to be processed of the second sub-display area on the second pixel location side.

In an embodiment, the number of the columns of the second pixels to be processed is calculated according to the following formula: $C=(m-h)/2$;

wherein C is the number of columns of the second pixels to be processed, m is the number of the columns of the pixels covered by the light transmissive region in the first direction, and h is the resolution of the first sub-display area in the first direction.

In an embodiment, the number of columns of the pixels to be processed of the second sub-display area on the first pixel location side is calculated according to the following formula: $P1=L1+C$; wherein, P1 is the number of the columns of the pixels to be processed of the second sub-display area on the first pixel location side, L1 is the number of the columns of the first pixels to be processed of the second sub-display area on the second pixel location side, and C is the number of columns of the second pixels to be processed; and/or, calculating, according to the following formula, the number of the columns of the pixels to be processed of the second sub-display area on the second pixel location side: $P2=L2+C$; wherein P2 is the number of the columns of the pixels to be processed of the second sub-display area on the second pixel location side, L2 is the number of the columns of the first pixels to be processed of the second sub-display area on the second pixel location side, and C is the number of the columns of the second pixels to be processed.

in an embodiment, the detecting a pixel location in the second sub-display area that corresponds to a boundary of the light transmissive region further comprises:

detecting a third pixel location in the second sub-display area that corresponds to a third boundary of the light transmissive region and a fourth pixel in the second sub-display area that corresponds to a fourth boundary of the light transmissive region, the fourth boundary being opposite to the third boundary, a direction from the third boundary to the fourth boundary being a second direction, which is perpendicular to the first direction;

the setting pixels of at least one side of the second sub-display area to display the same color as the non-light transmissive area further comprising: determining, according to the third pixel location, the fourth pixel location, and the resolution of the first sub-display area in the second direction, the number of the columns of the pixels to be processed of the second sub-display area on the third pixel location side and/or the fourth pixel location side;

setting the pixels to be processed of the second sub-display area on the third pixel location side and/or the pixels to be processed of the second sub-display area on the fourth pixel location side to display the same color as the color of the non-light transmissive region.

The present disclosure provides a display device comprising: a cover plate and a display panel, which are configured in a stack; the cover plate comprises: a light transmissive region and a non-light transmissive region located around the light transmissive region; the display panel comprises a display area that is configured to correspond to the light transmissive region such that the display area is visible through the light transmissive region, wherein a size of the display area is greater than a size of the light transmissive region and the display area includes a first sub-display area and a second sub-display area located around the first sub-display area, pixels of at least one side of the second sub-display area are configured to display the same color as a color of the non-light transmissive area.

In an embodiment, the display panel further comprises a peripheral area provided with a black matrix, the peripheral area being located at a periphery of the second sub-display area.

The present disclosure further provides a detecting device, which is used in the display device and implements the above mentioned method, wherein the detecting device comprises an image collector, a signal generator and a controller, the signal generator is configured to load a test signal to the display device to cause the display device to display a scanning test line column by column in the first direction from a side of the display area at the first boundary;

the image collector is configured to record, during displaying the scanning test line, a first image information at the time when the scanning test line begins to appear in the light transmissive region, and a second image information at the time the scanning test line disappears;

the controller is configured to be connected to the image collector, configured to determine, according to the first image information, the first pixel location corresponding to the occurrence of the scanning test line, and configured, according to the second image information, to determine the second pixel location corresponding to disappearing of the scanning test line.

In an embodiment, the controller is further configured to write the first pixel location and the second pixel location to the display device to cause the display device to determine the second sub-display area and the first sub-display area according to the first pixel location and the second pixel location respectively.

DETAILED DESCRIPTION

The technical solutions in the present disclosure will be clearly and completely described in conjunction with the drawings in the present disclosure. It is obvious that the described embodiments are a part of the embodiments of the present disclosure, but not all of the embodiments. All other embodiments that are obtained by a person of ordinary skill in the art based on the embodiments of the present disclosure without departing from the inventive scope fall into the scope of the disclosure.

Figure 1A:
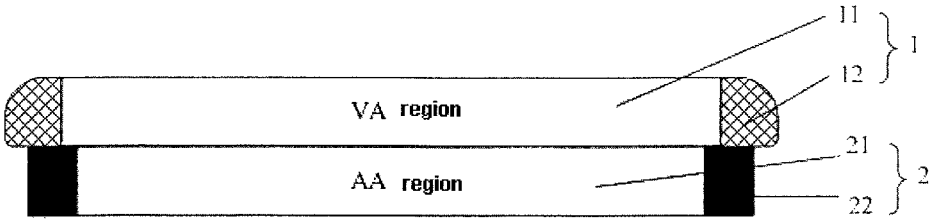
FIG. 1*a* is a schematic diagram showing a positional relationship between a light transmissive region and a display area in a display device in the related art.

The inventors have found that, in the related art, as shown in FIG. 1*a*, the display device includes a cover plate 1 and a display panel 2 which are arranged in a stack, and the display panel 2 includes a display area 21 (i.e., an area AA) and a peripheral area 22 disposed around the display area 21. In the peripheral area 22 a black matrix is usually disposed to ensure requirements for circuit wiring and liquid crystal sealing and so on. The cover plate 1 includes a light transmissive region 11 (i.e., a region VA) and a non-light transmissive region 12 at a periphery of the light transmissive region 11, and the non-light transmissive region 12 is usually coated with ink for blocking.

Figure 1B:
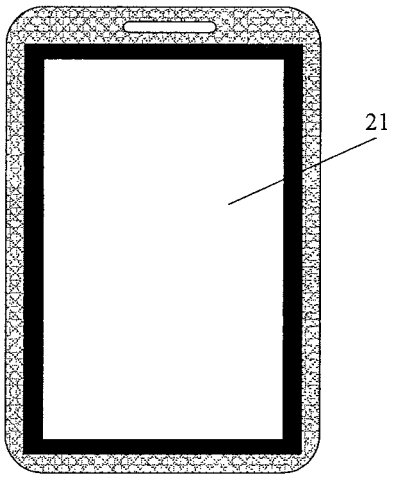
FIG. 1*b* is a schematic view showing a black border displayed in a periphery of a display device of the related art.

In order to prevent the light transmissive region 11 of the cover plate 1 from covering a pixel in the display area 21 of the display panel 2, a size of the light transmissive region 11 is generally set to be greater than a size of the display area 21. However, with the setting, as shown in FIG. 1*b*, the black matrix around the display area 21 below the cover plate 1 may be seen through the light transmissive region 11 of the cover plate 1, that is, a black border is displayed at a periphery of the display area 21 of the display panel 2, which affects visual effects.

Figure 2:
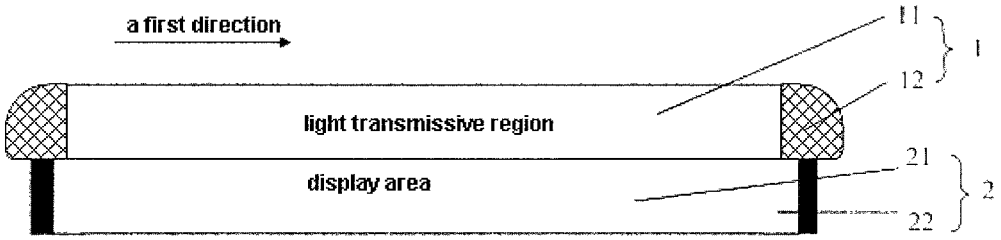
FIG. 2 is a schematic view showing a positional relationship between a light transmissive region and a display area in a display device of the present disclosure.
Figure 5:
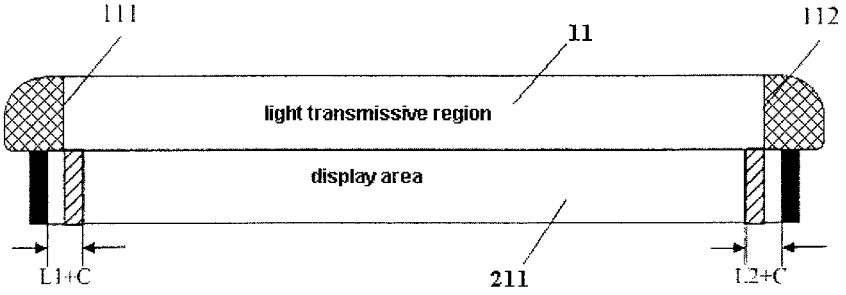
FIG. 5 is a schematic diagram illustrating the number of columns of the second pixels to be processed of the second sub-display area at the boundaries on the two sides thereof in the present disclosure.
Figure 6:
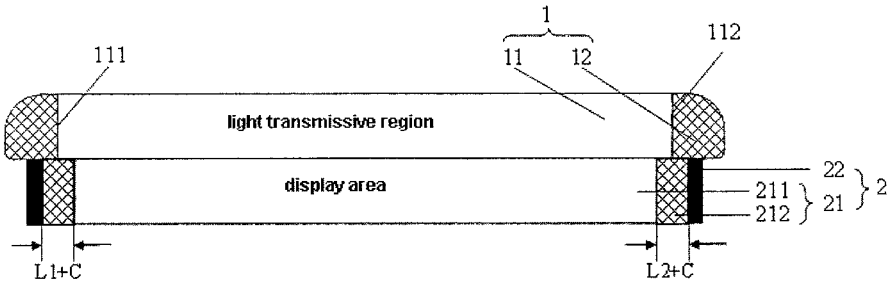
FIG. 6 is a schematic diagram of setting a color displayed by the pixel to be processed of the second sub-display area at the boundaries on both sides thereof to be the same color as a color of a non-light transmissive area of a cover plate in the present disclosure.

The present disclosure provides a method of eliminating a black border displayed in a display device. As shown in FIGS. 2-6, the display device includes a cover plate 1 and a display panel 2 which are stacked, and the cover plate 1 includes a light transmissive region 11 and a non-light transmissive area 12 at a periphery of the light transmissive region 11. The display panel 2 includes a display area 21, and the display area 21 corresponds to the light transmissive region 11 so that the display area 21 can be viewed through the light transmissive region 11, i.e., an orthographic projection of the light transmissive region 11 on the display panel 2 falls within the display area 21. As an example, a size of the display area 21 is greater than a size of the light transmissive region 11. The size of the display area 21 being greater than the size of the light transmissive region 11 can be understood that the total area of the display area 21 is greater than the total area of the light transmissive region 11. For example, when the display area 21 is rectangular, a longer side of the display area 21 is greater than the corresponding side of the light transmissive region 11 and a shorter side of the display area 21 is also greater than the corresponding side of the light transmissive region 11. It can also be understood that a region covered by the display area 21 contains a region covered by the light transmissive region 11, or, in a view as shown in FIG. 2, an orthographic projection of the display area 21 on a horizontal plane contains an orthographic projection of the light transmissive region 11 on the horizontal plane. As shown in FIG. 6, FIG. 6 is a cross-sectional view taken along a line A-A' in FIG. 7. The display area 21 includes a first sub-display area 211 and a second sub-display area 212 located in a periphery of the first sub-display area 211.

The method of eliminating the black border displayed in the display device includes the following steps:

making pixels of the second sub-display area 212 on at least one side display a same color as the color of the non-light transmissive area 12. Specifically, as shown in FIG. 6, an orthographic projection, on the cover plate 1, of one of the pixels away from an edge position is located within the range of the light transmissive region 11. That is, the display panel 2, upon being processed by the method of eliminating the black border of the display device of the present disclosure, has an effective display region 21 with a size less than the size of the light transmissive region 11 of the cover plate 1.

The non-light transmissive area 12 of the cover plate 1 is typically coated with ink, and the pixels of at least one side of the second sub-display area 212 display the same color as that of the ink.

According to the method of eliminating the black border of the display device provided by the present disclosure, the size of the display area 21 of the display panel 2 is greater than the size of the light transmissive region 11 of the cover plate 1, wherein the display area 21 includes a first sub-display area 211 in the middle of the display panel 2 and a second sub-display area 212 located around the first sub-display area 211 such that the pixels of at least one side of the second sub-display area 212 display the same color as that of the non-light transmissive area 12 of the cover plate 1. With the configuration, the size of the first sub-display area 211 is less than the size of the light transmissive region 11, and thus the pixels located at the boundary of the display area 21 (i.e., the pixels of the second sub-display area 212) may shield the block matrix between the peripheral area 22 and the first sub-display area 211 such that the black border displayed in the display device is eliminated and the display effect is improved.

In one embodiment, before the making pixels of the second sub-display area 212 on at least one side display the same color as that of the non-light transmissive area 12, the method of eliminating the black border of the display device according to an embodiment of the present disclosure further includes the following steps:

detecting positions of the pixels, corresponding to a boundary of the light transmissive region 11, in the second sub-display area 212, wherein the boundary of the light transmissive region 11 is a boundary corresponding to the pixels.

Figure 7:
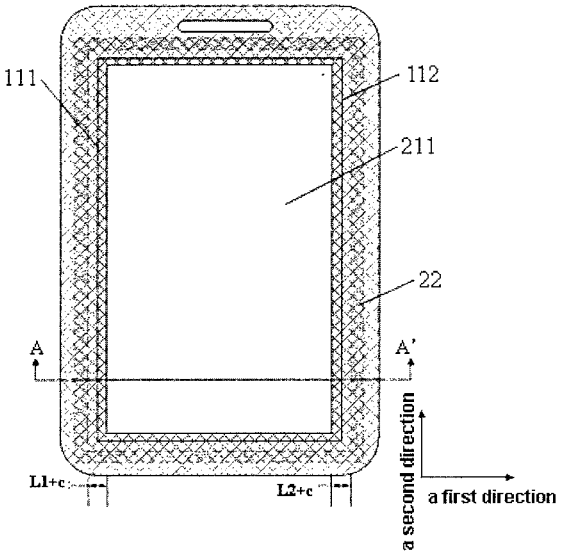
FIG. 7 is a plan view of the display device of the present disclosure.

As shown in FIG. 7, the display panel 2 has a rectangular shape, and the second sub-display area 212 has a "□" shape and includes two sides in each of a first direction (i.e., an x-axis direction) and a second direction (i.e., a y-axis direction).

Hereinafter, a method of eliminating the black border of the display device provided by the present disclosure will be described in detail with reference to FIGS. 3 to 6 as an example to eliminate the black border in the first direction.

Figure 3:
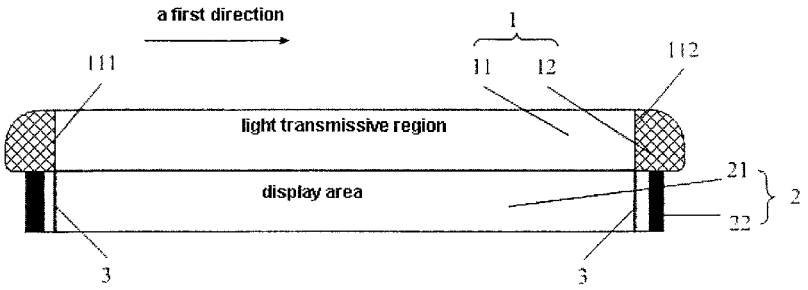
FIG. 3 is a schematic diagram showing appearance and disappearance of a bright detection line in the present disclosure.

As shown in FIG. 3, the step of detecting location of the pixels, corresponding to a boundary of the light transmissive region 11, in the second sub-display area 212 specifically includes:

detecting a first pixel location i, corresponding to a first boundary 111 of the light transmissive region 11, and a second pixel location j, corresponding to a second boundary 112 of the light transmissive region 11, in the second sub-display area 212. The second boundary 112 is opposite to the first boundary 111 and a direction from the first boundary 111 to the second boundary 112 is the first direction. In the present disclosure, the first boundary 111 is a left boundary of the light transmissive region 11, and the second boundary 112 is the right boundary of the light transmissive region 11.

Figure 4A:
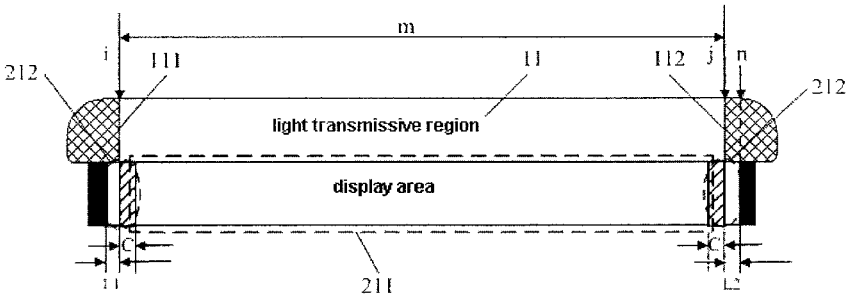
FIG. 4*a* is a first schematic diagram illustrating the number of columns of first pixels to be processed of a second sub-display area at boundaries on two sides thereof in the present disclosure.
Figure 4B:
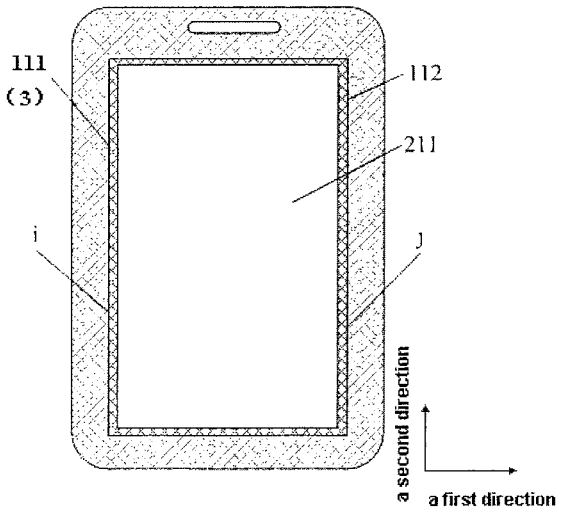
FIG. 4*b* is a second schematic diagram illustrating the number of columns of the first pixels to be processed of the second sub-display area at the boundaries on the two sides thereof in the present disclosure.

Specifically, as shown in FIG. 4*a* and FIG. 4*b*, a scanning test line 3 is displayed column by column in the first direction from a side of the display area 21 corresponding to the first boundary 111. The scanning test line 3 can be illuminated by loading a test signal to the data line of the display panel 2. The width of the scanning test line 3 is the width of the pixel. During a scanning process, the first pixel location i corresponding to the time when the scanning test line 3 starts to appear in the light transmissive region 11 and the second pixel location j corresponding to the time when the scanning test line 3 disappears in the light transmissive region 11 are recorded.

Since the size of the display area 21 is greater than the size of the light transmissive region 11, when the scanning test line 3 is displayed column by column from the left side of the display area 21, the scanning test line 3 will not be viewed although it has been lit because it is in the left edge area of the display area 21 and is shielded by the non-light transmissive area 12. Once the scanning test line 3 located at the right side of the first boundary 111 is lit or illuminated, it can be viewed because the illuminated scanning test line 3 is now in the range of the light transmissive region 11. That is, the scanning test line 3 can be lit and viewed within a range corresponding to the area (i.e., the light transmissive region 11) between the first boundary 111 and the second boundary 112 of the display area 21, and, once the scanning test line 3 located on the right side of the second boundary 112 is lit, the scanning test line 3 in the range of the display area 21 disappears.

In the process of displaying the scanning test line 3, the first pixel location i corresponding to the time when the scanning test line 3 starts to appear in the light transmissive region 11 and the second pixel location j corresponding to the time when the scanning test line 3 disappears in the light transmissive region 11 are recorded. The first pixel location i is the pixel location corresponding to the first boundary 111 of the light transmissive region 11, and the second pixel location j is the pixel location corresponding to the second boundary 112 of the light transmissive region 11.

In the present disclosure, the pixel location refers to the number of the column of pixels in the display panel 2, for example, the first pixel location i may be represented as the $100^{th}$ column of pixels of the display panel 2, and the second pixel location j may be represented as the $1000^{th}$ column of pixels of the display panel 2.

The step of making pixels of at least one side of the second sub-display area 212 display a same color as that of the ink on the non-light transmissive area 12 specifically includes the following steps:

a step 111 of determining, according to the first pixel location i, the second pixel location j, and a resolution of the first sub-display area 211 in the first direction, the number of columns of pixels to be processed that is at the first pixel location i side of the second sub-display area 212 and/or the number of columns of pixels to be processed that is at the second pixel location j side of the second sub-display area 212.

Specifically, as shown in FIGS. 2 and 3, the light transmissive region 11 is located at an intermediate position of the display region 21. As shown in FIG. 5, the number of columns of the pixels to be processed at the first pixel location i side of the second sub-display area 212 is L1+C, the number of columns of the pixels to be processed at the second pixel location j side of the second sub-display area 212 is L2+C.

The specific implementation of step 111 will be described in detail below with reference to FIGS. 4*a*-4*b* and FIG. 5.

The step of making further includes a step 112, causing the pixels to be processed of the second sub-display area 212 on the first pixel location i side and/or the pixels to be processed of the second sub-display area 212 on the second pixel location j side to display a same color as the color of the non-light transmissive area 12.

Specifically, as shown in FIG. 6, the (L1+C) columns of the pixels to be processed of the second sub-display area 212 at the first pixel location i side displays the same color as that of the ink on the non-light transmissive area 12; and/or, the (L2+C) columns of the pixels to be processed of the second sub display area 212 at the second pixel location j side displays the same color as that of the ink on the non-light transmissive area 12. With the configuration, when viewed from an outside of the display device (i.e., from the side of the cover plate 1 away from the display panel 2), it is visually equivalent to extend the non-transmissive region 12 from the boundary to the middle for a distance thereby achieving effect of blocking the black matrix in the peripheral area 22 of the display panel 2.

It should be noted that, as the first pixels to be processed of the second sub-display area 212 at the first pixel location i side and the first pixels to be processed of the second sub-display area 212 at the second pixel location j side are shielded by the non-light transmissive area 12, each of the number of the columns of pixels to be processed of the second sub-display area 212 at the first pixel location i side and located in the light transmissive region, and the number of the columns of pixels to be processed of the second sub-display area 212 at the second pixel location j side and located in the light transmissive region may be C. That is, only the C columns of second to-be-processed pixels, on the first pixel location i side and in the transmissive area, of the second sub-display area 212 and/or the C columns of second to-be-processed pixels, on the second pixel location j side and in the transmissive area, of the second sub-display area 212 may display the same color as that of the non-light transmissive region.

As shown in FIG. 4*a* and FIG. 5, determining, according to the first pixel location i, the second pixel location j, and the resolution of the first sub-display area 211 in the first direction, the number of columns of pixels to be processed of the second sub-display area 2112 on the first pixel location i side and/or on the second pixel location j side, (i.e. the step 111) includes:

a step 1111 of calculating, according to the first pixel location i and the second pixel location j, the number L1 of columns of the first pixels to be processed, on the first pixel location i side, of the second sub-display area 212 that are blocked by the non-light transmissive area 12, and/or the number L2 of columns of the first pixels to be processed, on the second sub-pixel location j side, of the second sub-display area 212 that are blocked by the non-light transmissive area 12, and the corresponding number m of columns of pixels of the display area 21 in the light transmissive area 11 in the first direction.

Specifically, as shown in FIG. 4*a*, if the first pixel location, corresponding to the first boundary 111 of the light transmissive area 11, in the second sub-display area 212 is the i-th column of pixels, the second pixel location j, corresponding to the second boundary 112 of the transparent area 11, in the second sub-display area 212 is the j-th column of pixels, and the total number of columns of the pixels of the display area 21 in the first direction is n, the number L1 of columns of the first pixels to be processed, on the first pixel location i side and covered by the non-transmissive region 12, of the second sub-display area 212 is equal to i, the number L2 of columns of the first pixels to be processed, on the second pixel location j side and covered by the non-transmissive region 12, of the second sub-display area 212 is equal to n−j+1 and the corresponding number m of columns of pixels of the light transmissive region 11 in the first direction is equal to j−i−1.

The above determining further includes a step 1112: calculating the number C of columns of the second pixels to be processed, according to the corresponding number m of columns of the pixels of the light transmissive region 11 in the first direction and the resolution of the first sub-display area 211 in the first direction.

Specifically, as shown in FIG. 4*a*, since the light transmissive region 11 is located at an intermediate position of the display area 21, the width of the second pixels to be processed, on the first pixel location i side, of the second sub-display area 212 is equal to the width of the second pixels to be processed, on the second pixel location j side, of the second sub-display area 212, i.e., each of them is C.

Specifically, the number C of columns of the second pixels to be processed can be calculated according to the following formula (1):

$$C=(m-h)/2; \quad (1)$$

where m is the corresponding number of columns of pixels of the light transmissive region 11 in the first direction, and h is a resolution of the first sub-display area 211 in the first direction. A resolution of the first sub-display area 211 is h×v, where h is the number of columns of pixels of the first sub-display area 211 in the first direction (i.e., the horizontal direction), and v is the number of rows of pixels of the first sub-display area 211 in the second direction (i.e., the vertical direction). Generally, for a Full High Definition (FHD) display panel, its resolution is usually 1080×1920, that is, there are 1080 columns of pixels in the first direction, and the pixels herein refer to R, G, B, W pixels, etc. It should be noted that the display panel 2 may also be a High Definition (HD) panel, a widescreen HD (2K resolution, WQHD) panel, a Quad Full High Definition (QFHD, 4K resolution,) panel, or the like.

The above determining further includes a step 1113 of calculating, according to the number L1 of columns of the first pixels to be processed and the number C of columns of the second pixels to be processed of the second sub-display area 212 on the first pixel location i side, a number P1 of columns of pixels to be processed of the second sub-display area 212 on the first pixel location i side, and/or, according to the number L2 of columns of the first pixels to be processed and the number C of columns of the second pixels to be processed of the second sub-display area 212 on the second pixel location j side, the number P2 of columns of pixels to be processed of the second sub-display area 212 on the second pixel location j side.

Specifically, as shown in FIG. 5, the number of columns of pixels to be processed of the second sub-display area 212 on the first pixel location i side can be calculated according to the following formula (2):

$$P1=L1+C; \quad (2)$$

where P1 is the number of columns of the pixels to be processed of the second sub-display area 212 on the first pixel location i side, L1 is the number of columns of the first pixels to be processed of the second sub-display area 212 on the first pixel location i side, and C is the number of columns of the second pixels to be processed.

The number of columns of the pixels to be processed of the second sub-display area 212 on the second pixel location j side can be calculated according to the following formula (3):

$$P2=L2+C \quad (3)$$

where P2 is the number of columns of the pixels to be processed of the second sub-display area 212 on the second pixel location j side, L2 is the number of columns of the first pixels to be processed of the second sub-display area 212 on the second pixel location j side, and C is the number of columns of the second pixels to be processed.

It should be noted that, not only the black border in the first direction of the display device, but also the black border in the second direction of the display device can be eliminated, that is, the black edges in a periphery of the display device can be eliminated, so that the display device can be further improved in terms of eliminating the black border.

Therefore, the step of detecting the pixel location, corresponding to the boundary of the light transmissive region 11, in the second sub-display area 212 further includes the following steps:

detecting a third pixel location, corresponding to the third boundary of the light transmissive region 11, in the second sub-display area 212 and a fourth pixel location, corresponding to the fourth boundary of the light transmissive region 11, in the second sub-display area 212, wherein the fourth boundary is opposite to the third boundary, and a direction from the third boundary to the fourth boundary is the second direction that is perpendicular to the first direction.

In the embodiments of the present disclosure, the third boundary is an upper boundary of the light transmissive region 11, and the fourth boundary is a lower boundary of the light transmissive region 11.

It should be noted that the process of detecting the third pixel location and the fourth pixel location is same as the process of detecting the first pixel location i and the second pixel location j, and thus will not be described repeatedly herein again.

Correspondingly, after the detecting the third pixel location and the fourth pixel location, the step of causing the pixels of at least one side of the second sub-display area 212 to display the same color as that of the non-light transmissive area 12 further includes the following steps:

a step 111' of determining, according to the third pixel location, the fourth pixel location, and the resolution of the first sub-display area 211 in the second direction, the number of columns of pixels to be processed of the second sub-display area 212 on the third pixel location side and/or the fourth pixel location side.

It should be noted that, the implementation process of determining the number of columns of the pixels to be processed of the second sub-display area 212 on the third pixel location side and/or the fourth pixel location side is the same as the process of determining the number of columns of the pixels to be processed of the second sub-display area 212 on the first pixel location i side and/or the second pixel location j side, and thus will not be described repeatedly herein again.

The above step of causing further includes a step 112' of causing the pixels to be processed of the second sub-display area 212 on the third pixel location side and/or on the fourth pixel location side to display a same color as that of the non-light transmissive region 12 is further included.

The present disclosure also provides a display device. As shown in FIG. 6, the display device includes a cover plate 1 and a display panel 2 which are arranged in a stack. The cover plate 1 includes a light transmissive region 11 and a non-transmissive light area 12 located around the light transmissive region 11. The display panel 2 includes a display area 21 corresponding to the light transmissive region 11, and preferably, a size of the display area 21 is greater than a size of the light transmissive region 11, however, the size of the display area 21 may be equal to the size of the light transmissive region 11; and, the display area 21 includes a first sub-display area 211 and a second sub-display area 212 located around the first sub-display area 211. Pixels of at least one side of the second sub-display area 212 are used to display a same color as that of the non-light transmissive area 12

The display device provided by the present disclosure includes a cover plate 1 and a display panel 2 which are arranged in a stack. The size of the display area 21 of the display panel 2 is greater than the size of the light transmissive region 11 of the cover plate 1, wherein the display area 21 includes a first sub-display area 211 located at an intermediate position of the display panel 2 and a second sub-display area 212 located around the first sub-display area 211. The size of the first sub-display area 211 is smaller than the size of the transparent area 11, the pixels of at least one side of the second sub-display area 212 display the same color as that of the non-light transmissive area 12 of the cover plate 1. The pixels at the boundary of the display area 21 (i.e., the pixels of the second sub-display area 212) block the black matrix located between a peripheral area 22 and the first sub-display area 211, thereby eliminating the black border of the display screen and improving the display effect.

In an embodiment, as shown in FIG. 6, the display panel 2 further includes a peripheral region 22 provided with a black matrix, and the peripheral region 22 is located at the periphery of the second sub-display area 212.

In an embodiment, the display panel 2 may include an LCD panel or an OLED panel.

The display device of the present disclosure may be any product or component having a display function such as a television, a display, a digital photo frame, a mobile phone, a smart watch, a tablet computer, a virtual device, and the like.

Figure 8:
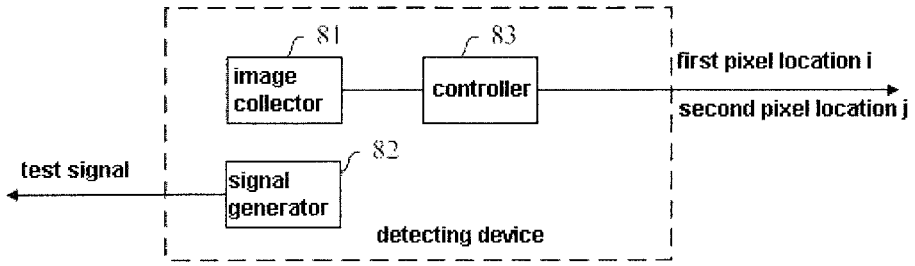
FIG. 8 is a schematic block diagram of a detection device of the present disclosure.

The present disclosure also provides a detecting device in which the method of eliminating the black border of the display device as described above is applied and which may be used in the display device. As shown in FIGS. 4*a* and 8, the detecting device includes an image collector 81, a signal generator 82 and a controller 83. The signal generator 82 is configured to load a test signal to the display device to cause the display device to display the scanning test line 3 column by column in a first direction from the side of the display area 21 at the first boundary. For example, the signal generator 82 may be a signal generating circuit.

The image collector 81 is configured to record a first image information at the time when the scanning test line starts to appear in the light transmissive region 11 and a second image information at the time when the scanning test line disappears during the scanning process.

In an embodiment, the image collector 81 may be an image collector device, such as a camera.

The controller 83 is configured to be connected to the image collector 81 for determining, according to the first image information, a first pixel location i corresponding to the time when the scanning test line appears and determining, according to the second image information, a second pixel location j corresponding to the time when the scanning test line disappears. The controller 83 may be a control circuit.

In one embodiment, the controller 83 is further configured to write the first pixel location i and the second pixel location j to the display device such that the display device determines the second sub-display area 212 and the first sub-display area 211 based on the first pixel location i and the second pixel location j.

The technical solution for eliminating the black border of the display device according to the present disclosure is provided to shield the second sub-display area 212 of the display area 21 as an extended display area to eliminate the black border of the display device, thereby improving the display effect and the user experience of the terminal device. Further the solution of the present disclosure can be applied to almost all types of display panels and their terminal devices.

It is to be understood that the above embodiments are merely exemplary embodiments employed to explain the principles of the present disclosure, but the present disclosure is not limited thereto. Various modifications and improvements can be made by those skilled in the art without departing from the spirit and scope of the disclosure, and such modifications and improvements are also considered as falling within the scope of the present disclosure.

What is claimed is:

1. A method of eliminating a black border of a display device, the display device comprising a cover plate and a display panel that are provided in a stack, the cover plate comprising a light transmissive region and a non-light transmissive region located around the light transmissive region and the display panel comprising a display area such that an orthographic projection of the light transmissive region on the display panel falls within the display area, the method comprising the steps of:

configuring the display area to include a first sub-display area and a second sub-display area located around the first sub-display area; and setting pixels, on at least one side, of the second sub-display area to display a same color as that of the non-light transmissive area, wherein, before setting the pixels, on the at least one side, of the second sub-display area to display the same color as that of the non-light transmissive area, the method further comprises the following steps:

detecting a pixel location at which an orthographic projection of a boundary of the light transmissive region in the second sub-display area is located, wherein the detecting the pixel location at which an orthographic projection of the boundary of the light transmissive region in the second sub-display area is located comprises:

detecting a first pixel location where an orthographic projection of a first boundary of the light transmissive region in the second sub-display area is located and a second pixel location where an orthographic projection of a second boundary of the light transmissive region in the second sub-display area is located, the second boundary being opposite to the first boundary, and a direction from the first boundary to the second boundary being a first direction, wherein the detecting a first pixel location where an orthographic projection of a first boundary of the light transmissive region in the second sub-display area is located and a second pixel location where an orthographic projection of a second boundary of the light transmissive region in the second sub-display area is located comprises:

displaying a scanning test line column by column in the first direction from a side of the display area at the first boundary; during the displaying scanning test line, recording a position corresponding to a time when the scanning test line starts to appear in the light transmissive area as the first pixel location and recording a position corresponding to a time when the scanning test line disappears in the light transmissive area as the second pixel location.

2. The method as claimed in claim 1, wherein the setting pixels, on at least one side, of the second sub-display area to display a same color as that of the non-light transmissive area comprises:

determining, according to the first pixel location, the second pixel location, and a resolution of the first sub-display area in the first direction, a number of columns of pixels to be processed of the second sub-display area on the first pixel location side and/or of the second pixel location side; and setting the pixels to be processed of the second sub-display area in the light transmissive region on the first pixel location side and/or on the second pixel location side to display the same color as the color of the non-light transmissive area.

3. The method as claimed in claim 2 wherein the light transmissive region is located at an intermediate position of the display area;

the determining, according to the first pixel location, the second pixel location, and a resolution of the first sub-display area in the first direction, a number of columns of pixels to be processed of the second sub-display area on the first pixel location side and/or the second pixel location side comprises:

calculating, according to the first pixel location and the second pixel location, a number of columns of first pixels to be processed of the second sub-display area, shielded by the non-light transmissive area, on the first pixel location side and/or the second pixel location side, and a number of columns of pixels arranged in the first direction and covered by the light transmissive region;

calculating, according to the number of the columns of the pixels arranged in the first direction and covered by the light transmissive region and the resolution of the first sub-display area in the first direction, a number of columns of second pixels to be processed of the second sub-display area covered by the light transmissive region; and calculating, according to the number of the columns of the first pixels to be processed of the second sub-display area on the first pixel location side and the number of the columns of the second pixels to be processed, the number of the columns of the pixels to be processed of the second sub-display area on the first pixel location side and/or, according to the number of the columns of the first pixels to be processed of the second sub-display area on the side of the second pixel and the number of the columns of the second pixels to be processed, the number of the columns of the pixels to be processed of the second sub-display area on the second pixel location side.

4. The method as claimed in claim 3, wherein the number of the columns of the second pixels to be processed is calculated according to the following formula: $C=(m-h)/2$;

wherein C is the number of the columns of the second pixels to be processed, m is the number of the columns of the pixels covered by the light transmissive region in the first direction, and h is the resolution of the first sub-display area in the first direction.

5. The method as claimed in claim 3, wherein the number of the columns of the pixels to be processed of the second sub-display area on the first pixel location i side calculated according to the following formula: $P1=L1+C$; wherein, P1 is the number of the columns of the pixels to be processed of the second sub-display area on the first pixel location side, L1 is the number of the columns of the first pixels to be processed of the second sub-display area on the first pixel location side, and C is the number of the columns of the second pixels to be processed; and/or, the number of the columns of the pixels to be processed of the second sub-display area on the second pixel location i side calculated according to the following formula: $P2=L2+C$; wherein P2 is the number of the columns of the pixels to be processed of the second sub-display area on the second pixel location side, L2 is the number of the columns of the first pixels to be processed of the second sub-display area on the second pixel location side, and C is the number of the columns of the second pixels to be processed.

6. The method as claimed in claim 1, wherein the detecting a pixel location at which an orthographic projection of a boundary of the light transmissive region in the second sub-display area is located further comprises:

detecting a third pixel location at which an orthographic projection of a third boundary of the light transmissive region in the second sub-display area is located and a fourth pixel location at which an orthographic projection of a fourth boundary of the light transmissive region in the second sub-display area is located, the fourth boundary being opposite to the third boundary, a direction from the third boundary to the fourth boundary being a second direction, which is perpendicular to the first direction;

the setting pixels, on at least one side, of the second sub-display area to display a same color as that of the non-light transmissive area further comprises: determining, according to the third pixel location, the fourth pixel location, and a resolution of the first sub-display area in the second direction, a number of columns of pixels to be processed of the second sub-display area on the third pixel location side and/or the fourth pixel location side; and setting the pixels to be processed of the second sub-display area on the third pixel location side and/or the pixels to be processed of the second sub-display area on the fourth pixel location side to display a same color as the color of the non-light transmissive region.

7. The method as claimed in claim 1, wherein a size of the display area is greater than a size of the light transmissive region.

8. A detecting device, which is used in a display device and implements the method as claimed in claim 1, the display device comprising:

a cover plate and a display panel, which are configured in a stack;

wherein the cover plate comprises: a light transmissive region and a non-light transmissive region located around the light transmissive region;

wherein the display panel comprises a display area, and an orthographic projection of the light transmissive region on the display panel falls within the display area, and wherein, the display area includes a first sub-display area and a second sub-display area located around the first sub-display area, and pixels, on at least one side, of the second sub-display area are configured to display a same color as a color of the non-light transmissive area;

wherein the detecting device comprises an image collector, a signal generator and a controller, wherein the signal generator is configured to load a test signal to the display device to cause the display device to display a scanning test line column by column in the first direction from a side of the display area at the first boundary;

wherein the image collector is configured to record, during displaying the scanning test line, a first image information at a time when the scanning test line begins to appear in the light transmissive region, and a second image information at a time when the scanning test line disappears; and wherein the controller is configured to be connected to the image collector, and configured to determine, according to the first image information, the first pixel location corresponding to the appearing of the scanning test line, and according to the second image information, to determine the second pixel location corresponding to the disappearing of the scanning test line.

9. The detecting device as claimed in claim 8, wherein the controller is further configured to write the first pixel location and the second pixel location to the display device to cause the display device to determine the second sub-display area and the first sub-display area according to the first pixel location and the second pixel location respectively.

* * * * *